US008196917B2

(12) United States Patent
Shiba

(10) Patent No.: US 8,196,917 B2
(45) Date of Patent: Jun. 12, 2012

(54) DETACHABLE FEED MEMBER WITH DETECTION UNIT

(75) Inventor: Tetsuo Shiba, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/543,900

(22) Filed: Aug. 19, 2009

(65) Prior Publication Data

US 2010/0059925 A1 Mar. 11, 2010

Related U.S. Application Data

(60) Provisional application No. 61/095,285, filed on Sep. 8, 2008.

(51) Int. Cl.
*B65H 5/00* (2006.01)

(52) U.S. Cl. ..... 271/10.03; 271/265.01; 271/273

(58) Field of Classification Search ..... 271/10.03, 271/258.01, 265.01, 273, 274
See application file for complete search history.

(56) References Cited

U.S. PATENT DOCUMENTS

| | | | | |
|---|---|---|---|---|
| 5,547,179 | A * | 8/1996 | Wilcox et al. | 271/3.2 |
| 6,295,081 | B1 * | 9/2001 | Kashima et al. | 347/262 |
| 2006/0214355 | A1 * | 9/2006 | Fukao | 271/10.11 |

FOREIGN PATENT DOCUMENTS

JP 2008-83976 A 4/2008

* cited by examiner

*Primary Examiner* — Jeremy R Severson
(74) *Attorney, Agent, or Firm* — Patterson & Sheridan, LLP

(57) ABSTRACT

In an embodiment of the invention, a detection unit arranged near a feed roller is rotatably arranged. A space where the feed roller is attached and detached is formed by rotating the detection unit. The detection unit is rotated in accordance with an operation of attaching and detaching the feed roller to and from a shaft, and the maintenance of the feed roller is performed while the formed space is used.

18 Claims, 7 Drawing Sheets

DETACHABLE FEED MEMBER WITH DETECTION UNIT

CROSS REFERENCE TO RELATED APPLICATION

This application is based upon and claims the benefit of priority from Provisional U.S. Application 61/095,285 filed on Sep. 8, 2008, the entire contents of which are incorporated herein by reference.

TECHNICAL FIELD

The present invention relates to an image forming apparatus, such as a copier or a MFP (multi-function peripheral), and a sheet feeding device for feeding a sheet in the image forming apparatus.

BACKGROUND

In sheet feeding devices of image forming apparatuses, there is a device in which a sheet detection sensor is arranged near a feed roller to transport a sheet taken out by a pick-up roller. In the device in which the sheet detection sensor is arranged near the feed roller, when the attachment and detachment operation of the feed roller is performed at the time of maintenance or the like, the sheet detection sensor hinders the attachment and detachment operation of the feed roller.

Hitherto, in order to perform the attachment and detachment operation of the feed roller, it is necessary to attach and detach the sheet detection sensor. Thus, it takes much time to perform the attachment and detachment of the feed roller, or the maintenance can not be performed except by an expert serviceman, and there is a fear that the operationality at the time of maintenance becomes inferior.

It is desired to develop a sheet feeding device in an image forming apparatus, in which it is not necessary to attach and detach a peripheral sheet detection sensor at the time of attachment and detachment of a feed roller, and the operationality at the time of maintenance is improved.

SUMMARY

According to an aspect of the invention, attachment and detachment of a feed roller is facilitated and the operation of maintenance of a sheet feeding device is eased.

According to an embodiment, a sheet feeding device includes a feed member to transport a sheet in a containing section in a feeding direction, and a detection unit which has a detection element to detect that the sheet passes through a position of the feed member, and rotates and moves to form a space for attachment and detachment of the feed member at a position adjacent to the feed member.

DETAILED DESCRIPTION

Figure 1:
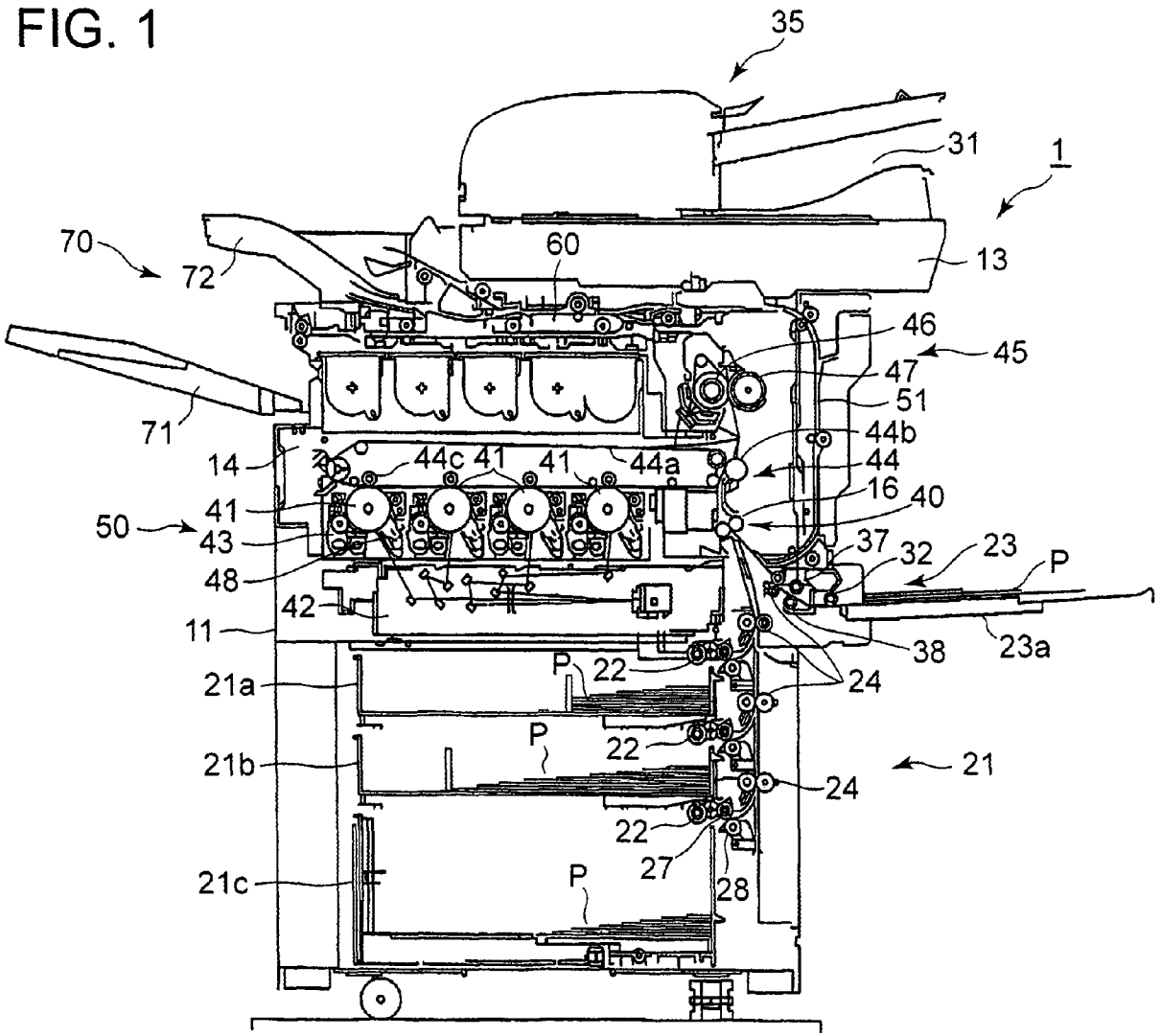
FIG. 1 is a schematic structural view showing a copier of an embodiment.

Hereinafter, embodiments will be described. FIG. 1 is a schematic structural view of a copier 1 as an image forming apparatus in which a sheet feeding device of an embodiment is mounted. The copier 1 includes a scanner section 13 to read an image, a printer section 14 to form an image, a sheet feeding device 21 and a bypass sheet feeding device 23 to feed a sheet P, and a sheet ejection section 70 including a first tray 71 and a second tray 72 to store the sheet P ejected from the printer section 14. A transport path 40 of the sheet P is provided between the sheet feeding device 21 or the bypass sheet feeding device 23 and the sheet ejection section 70 via the printer section 14.

The scanner section 13 scans an object (hereinafter referred to as an original document) which is fed from an auto document feeder (ADF) 35 and has image information, and captures the image information as image data. After the reading of the image information by the scanner section 13 is ended, the ADF 35 discharges the original document to a document discharge section 31.

The printer section 14 forms an image corresponding to inputted image information or the image information read by the scanner section 13 onto the sheet P. The printer section 14 includes four sets of image formation units 50 of yellow (Y), magenta (M), cyan (C) and black (K), an exposure device 42, a transfer unit 44 to transfer a toner image formed by the image formation units 50 to the sheet P, and a fixing unit 45 to fix the toner image to the sheet P on which the toner image is transferred by the transfer unit 44.

Each of the four sets of image formation units 50 has the same structure, and includes a photoconductive drum 41, a charging device 48 to uniformly charge the photoconductive drum 41, and a developing device 43 to form a toner image by developing an electrostatic latent image formed on the photoconductive drum 41 by irradiation of exposure light from the exposure device 42 after charging. The transfer unit 44 includes an intermediate transfer belt 44*a*, a primary transfer roller 44*c*, and a secondary transfer roller 44*b*. The fixing unit 45 includes an endless heat belt 46 and a press roller 47.

The transport path 40 includes a transport roller 24 to feed the sheet P fed from the sheet feeding device 21 or the bypass sheet feeding device 23 to the transfer unit 44, and a register roller 16. The transport path 40 transports the sheet P having the toner image fixed through the transfer unit 44 and the fixing unit 45 to the sheet ejection section 70 or a circulation path 51. The sheet ejection section 70 includes sheet ejection transport section 60 to eject the sheet P to the first tray 71 or the second tray 72, or to invert the sheet P. The circulation path 51 again guides the sheet P to the transfer unit 44.

In the foregoing copier 1, when the image formation starts, the photoconductive drum 41 is charged by the charging device 48, and then, the exposure device 42 irradiates the photoconductive drum 41 with exposure light, and forms an electrostatic latent image corresponding to the exposure light on the photoconductive drum 41. The electrostatic latent image formed on the photoconductive drum 41 is given toner by the developing device 43 and is visualized. The toner image obtained by visualizing the electrostatic latent image on the photoconductive drum 41 is transferred to the sheet P through the intermediate transfer belt 44*a* of the transfer unit 44.

After being fed from one of the sheet feeding device 21 and the bypass sheet feeding device 23, the sheet P reaches a nip between the intermediate transfer belt 44*a* and the secondary transfer roller 44*b* through the transport path 40 in synchronization with the toner image primarily transferred to the intermediate transfer belt 44*a*. While the sheet P passes through the nip between the intermediate transfer belt 44*a* and the secondary transfer roller 44*b*, the toner image on the intermediate transfer belt 44*a* is secondarily transferred to the sheet P. The sheet P having the toner image is transported to the fixing unit 45, and the toner image is fixed. After the toner image is fixed, the sheet P is ejected to the first tray 71 or the second tray 72 through the sheet ejection transport section 60, or is again guided through the circulation path 51 toward the secondary transfer roller 44*b* of the transfer unit 44.

Figure 2:
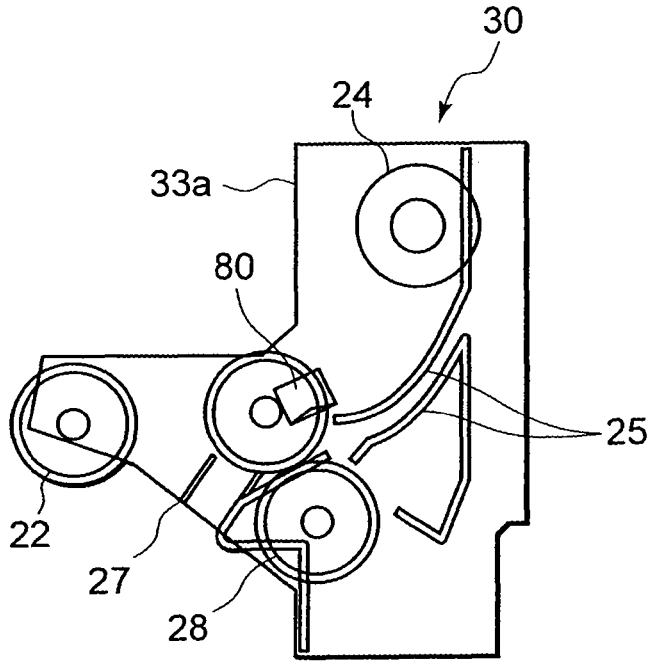
FIG. 2 is a schematic structural view showing a sheet feeding device and a bypass sheet feeding device of the embodiment.
Figure 3:
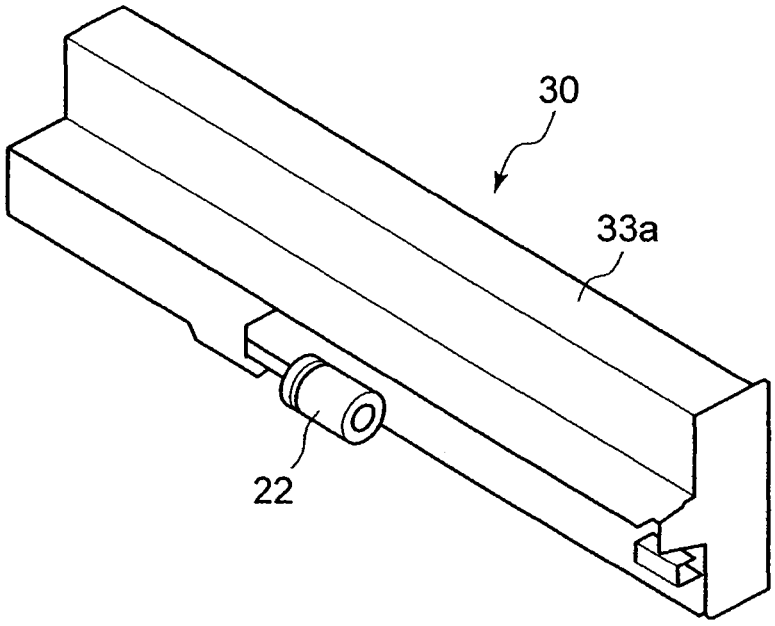
FIG. 3 is a schematic perspective view showing the sheet feeding device and the bypass sheet feeding device of the embodiment.

Next, the sheet feeding device 21 and the bypass sheet feeding device 23 will be described in detail. The sheet feeding device 21 includes an upper sheet feeding cassette 21*a*, a lower sheet feeding cassette 21*b* and a large capacity cassette 21*c* as a containing section. The sheet feeding device 21 includes a sheet feeding unit 30 shown in FIG. 2 and FIG. 3. The sheet feeding unit 30 includes a pick up roller 22 as a pick up member and a feed roller 27 as a feed member. The pick up roller 22 takes out the sheet P from the sheet feeding cassette 21*a*, 21*b* or and 21*c*. The sheet feeding unit 30 includes a separation roller 28 opposite to the feed roller 27, the transport roller 24 and a sheet guide 25.

The bypass sheet feeding device 23 includes a bypass tray 23*a*, a bypass pick up roller 32, and a bypass feed roller 37. The bypass pickup roller 32 takes out the sheet P from the bypass tray 23*a*. A bypass separation roller 38 is arranged to be opposite to the bypass feed roller 37. The bypass separation roller 38 prevents the sheets P from being multiply fed by the bypass feed roller 37.

Figure 4:
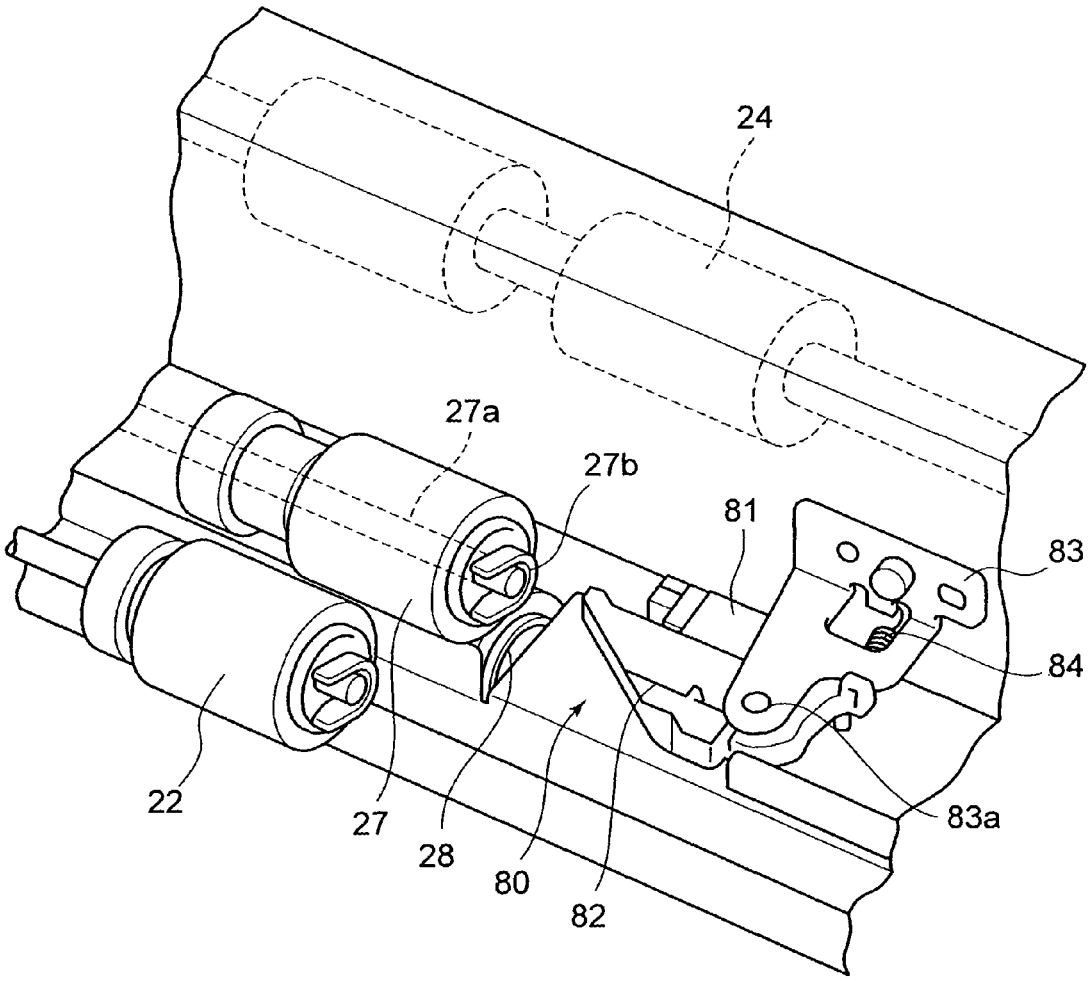
FIG. 4 is a schematic perspective view showing a feed roller and a detection unit of the embodiment.

As shown in FIG. 4, the feed roller 27 of the sheet feeding device 21 is slidably attached to a shaft 27*a*, and is fixed to the shaft 27*a* by a clip-like c-ring 27*b*. On the side of the bypass sheet feeding device 23, the bypass feed roller 37 is also fixed to a shaft 37*a* similarly to the feed roller 27.

A detection unit 80 is arranged at a position near the feed roller 27. The distance between the detection unit 80 and the feed roller 27 is not limited. It is sufficient if the detection unit 80 can detect the passing of the sheet P having a narrow lateral width, such as the vertical direction transport of a sheet of, for example, postcard size (100 mm×148 mm) or legal size (215.9 mm×355.6 mm) as the size of a US government document.

Figure 5:
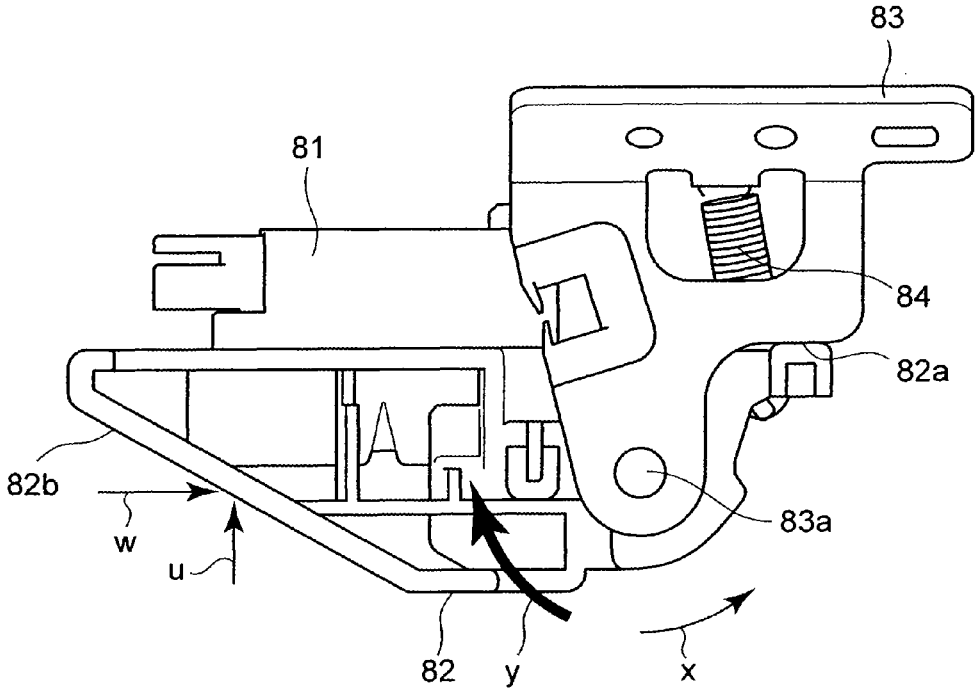
FIG. 5 is a schematic top view showing the detection unit of the embodiment.
Figure 6:
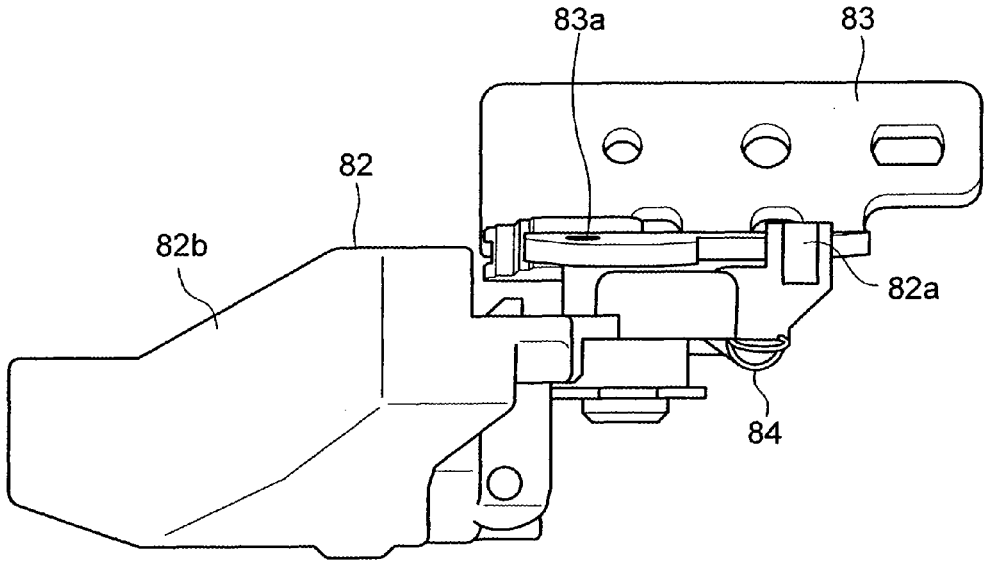
FIG. 6 is a schematic side view showing the detection unit of the embodiment.

As shown in FIG. 5 or FIG. 6, the detection unit 80 includes a sensor 81 as a detection element to detect the sheet P passing through the feed roller 27 and a case 82 to prevent the sheet P from colliding with the sensor 81. A bracket 83 is fixed to a housing 33*a* of the sheet feeding unit 30. The case 82 is supported by a rotation fulcrum 83*a* of the bracket 83 to be rotatable in both directions of an arrow×direction and an arrow y direction. A coil spring 84 as an urging member is stretched between the case 82 and the bracket 83. The coil spring 84 urges the case 82 in the arrow×direction.

The case 82 of the detection unit 80 is rotated in the arrow× direction by the coil spring 84, and a stopper 82*a* contacts with the bracket 83, so that the case is positioned at a detection position where the sensor 81 detects the passing of the sheet P. When a force to press a slider 82*b* of the case 82 in the arrow y direction is exerted, the case 82 rotates in the arrow y direction. In order to attach and detach the feed roller 27 to and from the shaft 27*a*, for example, when a worker presses the slider 82*b* in an arrow v direction, the detection unit 80 rotates in the arrow y direction. The detection unit 80 rotates in the arrow y direction, and a space where the feed roller 27 is attached to and detached from the shaft 27*a* is formed at a position adjacent to the shaft 27*a*. Besides, when the feed roller 27 or the worker's finger presses the slider 82*b* in an arrow w direction, the detection unit 80 rotates in the arrow y direction.

Figure 7:
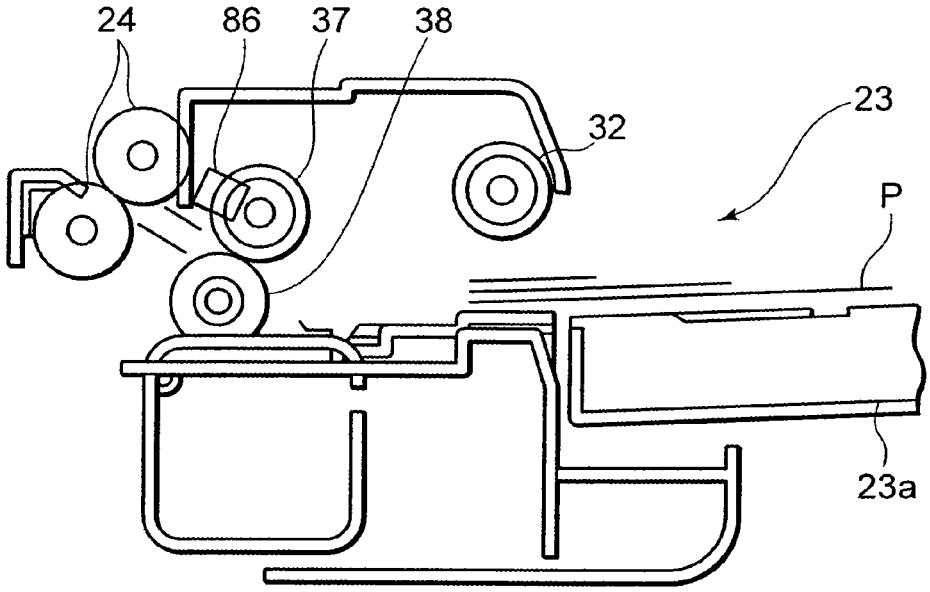
FIG. 7 is a schematic enlarged structural view showing the bypass sheet feeding device of the embodiment of FIG. 1.

As shown in FIG. 7, on the side of the bypass sheet feeding device 23, similarly to the detection unit 80 of the sheet feeding device 21, a bypass detection unit 86 is arranged at a position close to the bypass feed roller 37. The bypass detection unit 86 detects the sheet P passing through the bypass feed roller 37. Since the structure and operation of the bypass detection unit 86 is the same as the detection unit 80 of the sheet feeding device 21 although the direction of the arrangement is symmetrical to each other, its detailed description is omitted.

When the sheets P in the upper sheet feeding cassette 21*a* of the sheet feeding device 21 are continuously fed, after the image formation operation is started, the pick up roller 22 takes out one sheet P in the upper sheet feeding cassette 21*a* in synchronization with the timing of toner image formation in the printer section 14. Only the uppermost one sheet of the sheets P taken out by the pick up roller 22 is fed to the transport roller 24 by the feed roller 27 and the separation roller 28. Next, the sheet P reaches the register roller 16 through the transport path 40. After the leading edge of the sheet P is aligned by the register roller 16, the sheet P is transported to the position of the secondary transfer roller 44*b*.

The detection unit 80 is positioned at the detection position by the coil spring 84 and the stopper 82*a*, and the sensor 81 detects the leading edge and the trailing edge of the sheet P passing through the feed roller 27. At the time of continuous sheet feeding, the pick up roller 22 is driven by a trailing edge detection signal obtained when the sensor 81 detects the trailing edge of the sheet P, and a next sheet P is sequentially taken out from the upper sheet feeding cassette 21*a*. Accordingly, in order to enhance the sheet feeding speed by narrowing the interval between the sheets P as much as possible at the time of the continuous sheet feeding, it is desirable to arrange the sensor 81 adjacently to the pick up roller 22. When only one sheet P is fed, the trailing edge detection signal from the sensor 81 is not used for driving of the pick up roller 22.

After driving of the pick up roller 22, when the sensor 81 does not detect the leading edge of the sheet P before a specified time elapses, the sensor detects that a paper jam occurs at the position of the pick up roller 22. Besides, after detection of the leading edge of the sheet P, when the sensor 81 does not detect the trailing edge of the sheet P before a specified time elapses, the sensor detects that a paper jam occurs at the position of the feed roller 27.

Also in the lower cassette 21*b* and the large capacity cassette 21*c*, the sheet P is fed similarly to the sheet feeding of the upper sheet feeding cassette 21*a*. Besides, also in the bypass sheet feeding device 23, the sheet P on the bypass tray 23*a* is fed similarly to the sheet feeding of the upper sheet feeding cassette 21*a*. The bypass pick up roller 32 takes out the sheet, and the bypass feed roller 37 and the bypass separation roller 38 transport the uppermost sheet P in the direction toward the transport roller 24. The bypass detection unit 86 detects the sheet P passing through the bypass feed roller 37.

Figure 8:
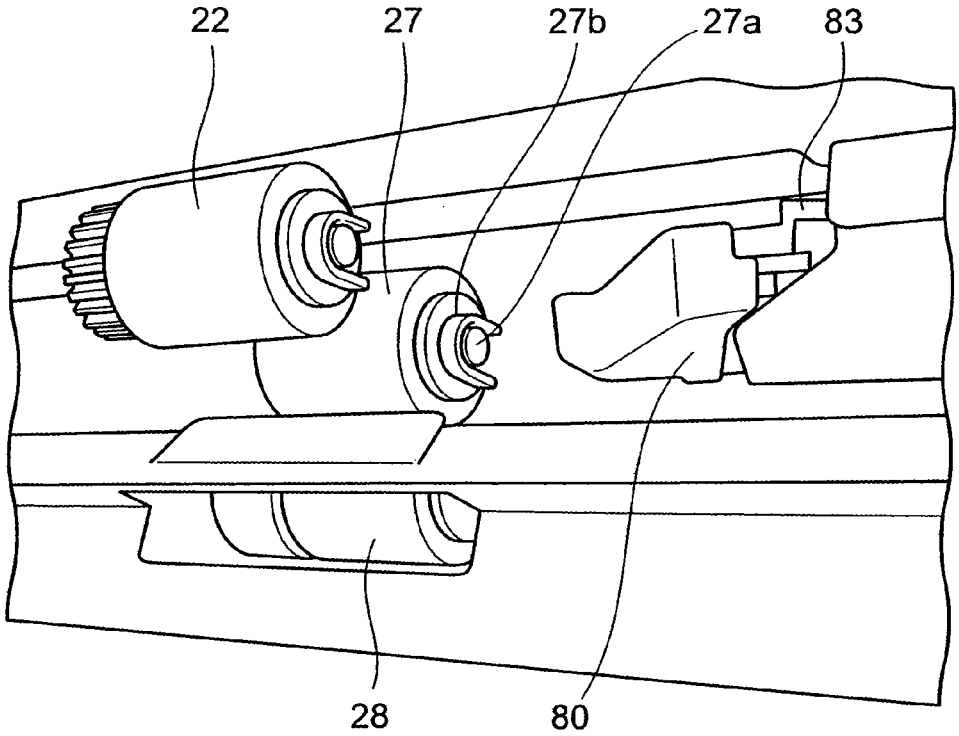
FIG. 8 is a schematic perspective view of the feed roller and the detection unit of the embodiment seen from a sheet insertion side.
Figure 9:
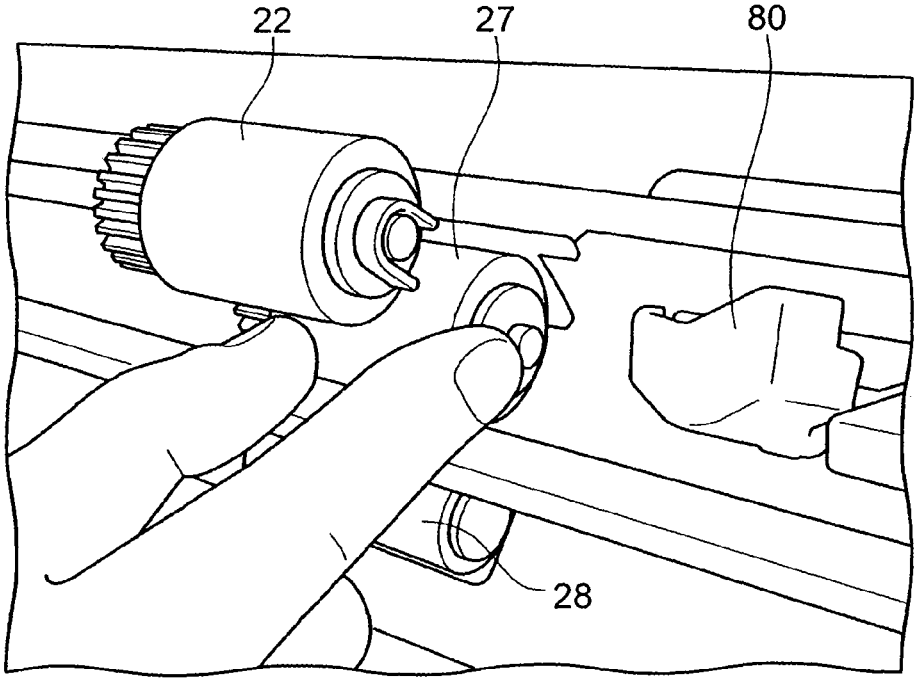
FIG. 9 is a schematic explanatory view showing a state where a worker pinches the feed roller of the embodiment.

When the feed roller 27 is soiled or worn while the feed roller 27 transports the sheet P, the maintenance of cleaning or replacing the feed roller 27 is performed. At the time of the maintenance, a worker such as a serviceman or an operator (1) draws out the sheet feeding unit 30 from the copier 1, (2) pulls out the c-ring 27*b*, which fixes the feed roller 27 to the shaft 27*a*, from the shaft 27*a* from the insertion side of the sheet P of the sheet feeding unit 30 shown in FIG. 8, (3) pinches the feed roller 27 with fingers (FIG. 9), and (4) slides the feed roller 27 along the shaft 27*a* in an arrow t direction (FIG. 10).

Figure 10:
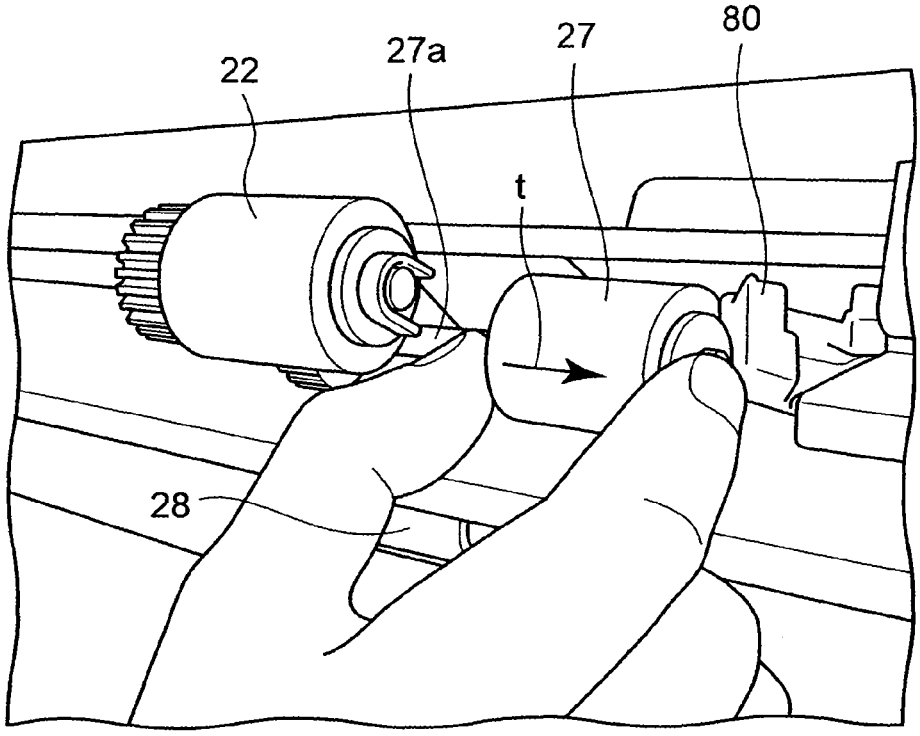
FIG. 10 is a schematic explanatory view showing a state where the worker slides the feed roller of the embodiment.
Figure 11:
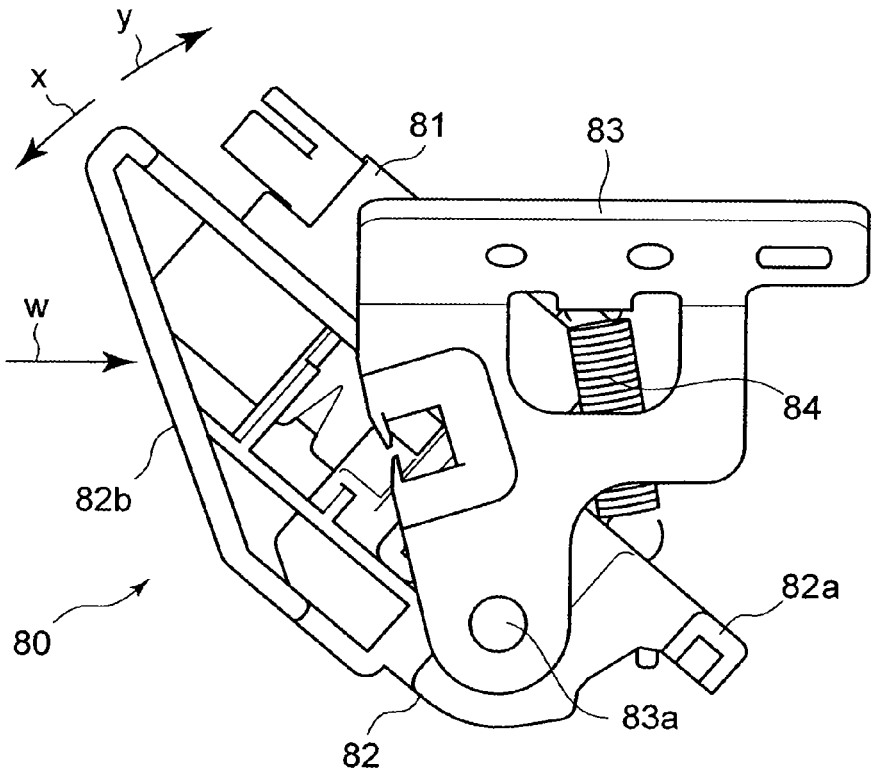
FIG. 11 is a schematic top view showing rotation of the detection unit of the embodiment.

When the feed roller 27 is slid in the arrow t direction along the shaft 27*a*, a force in the arrow w direction is exerted on the slider 82*b* of the case 82 of the detection unit 80 by the pressing of the feed roller 27, and the detection unit 80 rotates in the arrow y direction as shown in FIG. 10 and FIG. 11. When the detection unit 80 rotates in the arrow y direction, a space where the feed roller 27 can be attached and detached is formed at a position adjacent to the shaft 27*a*. Accordingly, the worker (5) uses the formed space and pulls out the feed roller 27 from the shaft 27*a*.

When the feed roller 27 is pulled out, the detection unit 80 is rotated in the arrow×direction by the coil spring 84, the stopper 82*a* collides with the bracket 83, and the detection unit 80 returns to the detection position. Thereafter, the worker mounts the cleaned feed roller 27 or a new feed roller 27 for replacement on the shaft 27*a*.

Figure 12:
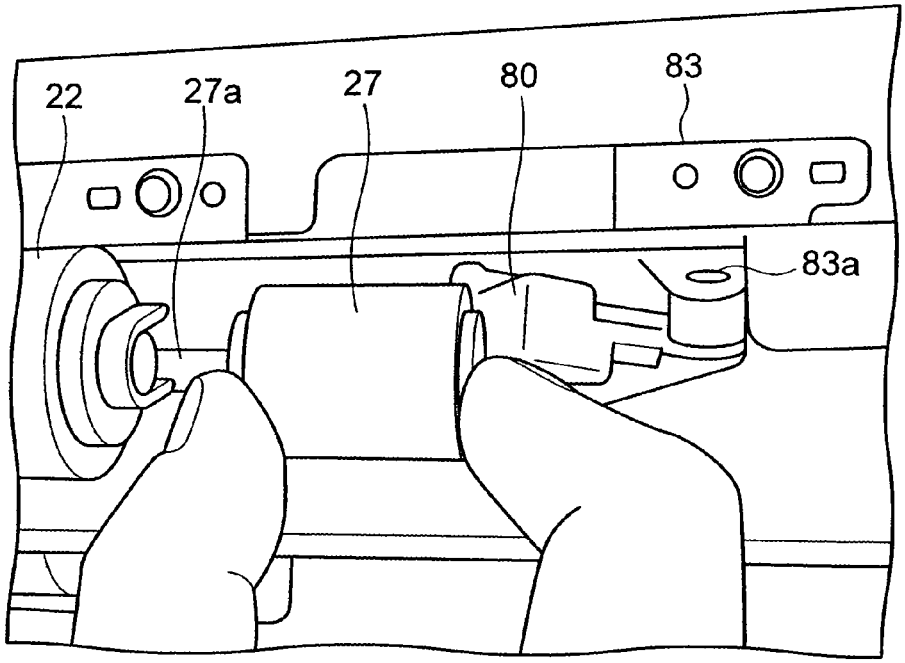
FIG. 12 is a schematic explanatory view showing a state where the worker presses in the feed roller of the embodiment.

As shown in FIG. 12, the worker (6) presses the pinched feed roller 27 in a direction crossing the shaft 27*a*. By the working operation such as collision of the feed roller 27 or the worker's finger with the slider 82*b* of the case 82 of the detection unit 80, a force in the arrow v direction is exerted on the slider 82*b*. The detection unit 80 rotates in the arrow y direction, and a space where the feed roller 27 can be attached and detached is formed at a position adjacent to the shaft 27*a*. Accordingly, the worker (7) uses the formed space to mount the feed roller 27 on the shaft 27*a*, and (8) fits the c-ring 27*b* on the shaft 27*a*, and fixes the feed roller 27 to the shaft 27*a*.

When the feed roller 27 is mounted on the shaft 27*a*, the detection unit 80 rotates in the arrow×direction by the coil spring 84, the stopper 82*a* contacts with the bracket 83, and the detection unit 80 returns to the detection position. After the feed roller 27 is mounted, it is not necessary to perform position adjustment of the detection unit 80. Thereafter, the worker mounts the sheet feeding unit 30 in the copier 1, and ends the maintenance.

According to the embodiment, by merely rotating the detection unit 80, the space where the feed roller 27 is attached to and detached from the shaft 27*a* is formed at the position adjacent to the shaft 27*a*. By merely sliding the feed roller 27 along the shaft 27*a* or merely pressing the feed roller 27 to the position adjacent to the shaft 27*a*, the worker can rotate the detection unit 80 very easily, and can perform the attachment and detachment operation of the feed roller 27 very easily by using the formed space. At the time of attachment and detachment of the feed roller, it is not necessary to attach and detach the detection sensor 80 unlike the related art, and the operationality at the time of maintenance can be remarkably improved.

According to the embodiment, at the time of maintenance of the feed roller 27, it is not necessary to attach and detach the detection unit 80, and at the time of end of maintenance, the detection unit 80 is easily returned to the detection position by the coil spring 84. The position adjustment of the detection unit 80 resulting from the attachment and detachment of the feed roller becomes unnecessary, even a person other than an expert serviceman can attach and detach the feed roller 27, and the service performance can be improved.

The invention is not limited to the above embodiment, and can be variously modified within the scope of the invention. For example, the arrangement and the number of containing sections, the material and size of the sheet, and the like are not limited. The distance between the pick up member and the feed member is not limited. However, at the time of continuous sheet feeding, in order to enhance the sheet feeding speed by narrowing the interval between sheets, it is preferable to further shorten the distance between the pick up member and the feed member. Besides, the shape of the case to protect the detection element is not limited, and it is sufficient if the case can be rotated by being pressed by the feed member or by the working operation of the worker. The shape of the elastic member to return the case to the detection position, the attachment position thereof and the like are not also limited.

What is claimed is:

1. A sheet feeding device comprising:

a feed roller to transport a sheet in a containing section in a feeding direction; and a detection unit which is arranged to be close to the feed roller, has a detection element to detect passing of the sheet, and is rotated and moved by an attachment and detachment operation of the feed roller to form a space for attachment and detachment of the feed roller at a position adjacent to the feed roller.

2. The device of claim 1, further comprising a pick up member to take out the sheet from the containing section, wherein the feed roller transports the sheet taken out by the pick up member in the feeding direction.

3. The device of claim 2, wherein the detection element detects a trailing edge of the sheet passing through the feed roller, and the pick up member sequentially takes out the sheet from the containing section in accordance with a detection of the trailing edge of the sheet by the detection element.

4. The device of claim 1, wherein the detection unit includes a case to contain the detection element, and the case is rotatably and movably attached to a fixed bracket, and is urged by an urging member in a direction of rotating and returning to a detection position.

5. The device of claim 1, wherein the space has a width through which the feed roller can be pulled out from a shaft in the attachment and detachment operation of the feed roller.

6. The device of claim 1, wherein the attachment and detachment operation of the feed roller is an operation in which a worker pulls out the feed roller from a shaft or attaches the feed roller to the shaft.

7. The device of claim 6, wherein the detection unit includes a case to contain the detection element, and the case is rotatably and movably attached to a fixed bracket, and is urged by an urging member in a direction of rotating and returning to a detection position.

8. The device of claim 7, wherein after the operation of pulling out the feed roller from the shaft is ended or after the operation of attaching the feed roller to the shaft is ended, the case is rotated and returned to the detection position.

9. An image forming apparatus comprising:

an image carrier;

an image forming unit to form a toner image on the image carrier;

a transfer unit to transfer the toner image to a sheet;

a fixing unit to fix the toner image transferred to the sheet;

a feed roller to transport the sheet in a containing section in a direction toward the transfer unit; and a detection unit which has a detection element to detect that the sheet passes through a position of the feed roller, and is rotated and moved by an attachment and detachment operation of the feed roller to form a space for attachment and detachment of the feed roller at a position adjacent to the feed roller.

10. The apparatus of claim 9, further comprising a pick up member to take out the sheet from the containing section, wherein the feed roller transports the sheet taken out by the pick up member in a feeding direction.

11. The apparatus of claim 10, wherein the detection element detects a trailing edge of the sheet passing through the feed roller, and the pick up member sequentially takes out the sheet from the containing section in accordance with a detection of the trailing edge of the sheet by the detection element.

12. The apparatus of claim 9, wherein the detection unit includes a case to contain the detection element, and the case is rotatably and movably attached to a fixed bracket, and is urged by an urging member in a direction of rotating and returning to a detection position.

13. The apparatus of claim 9, wherein the space has a width through which the feed roller moves with respect to a shaft in the attachment and detachment operation of the feed roller.

14. The apparatus of claim 9, wherein the attachment and detachment operation of the feed roller is an operation in which a worker pulls out the feed roller from a shaft or attaches the feed roller to the shaft.

15. The apparatus of claim 14, wherein the detection unit includes a case to contain the detection element, and the case is rotatably and movably attached to a fixed bracket, and is urged by an urging member in a direction of rotating and returning to a detection position.

16. The apparatus of claim 15, wherein after the operation of pulling out the feed roller from the shaft is ended or after the operation of attaching the feed roller to the shaft is ended, the case is rotated and returned to the detection position.

17. An attachment and detachment method of a feed member to which a detection unit of an image forming apparatus is provided to be close, comprising:

forming a space between the feed member and the detection unit by rotating the detection unit in accordance with a worker's operation of moving the feed member;

attaching and detaching the feed member in the space; and rotating and returning the detection unit to a detection position after an operation of detaching the feed member by the worker is ended or an operation of attaching the feed member by the worker is ended.

18. The method of claim 17, wherein the detection unit detects a trailing edge of a sheet passing through the feed member, and the feed member transports a sheet in a containing section in accordance with a detection result of the trailing edge of the sheet by the detection unit.

* * * * *